United States Patent [19]

Clement

[11] 3,971,474

[45] July 27, 1976

[54] METHOD AND APPARATUS FOR SORTING AND CLASSIFYING METALLIC CANS

[75] Inventor: John B. Clement, Marblehead, Mass.

[73] Assignee: Recor, Inc., Cambridge, Mass.

[22] Filed: Mar. 5, 1975

[21] Appl. No.: 555,705

[52] U.S. Cl. ..... 209/73; 209/39; 209/173; 209/75

[51] Int. Cl.[2] ..... B07C 1/00

[58] Field of Search ..... 209/33, 35, 39, 40, 209/162, 173, 214, 215, 219, 73, 74, 75, 81 A, 111.8

[56] References Cited

UNITED STATES PATENTS

| | | | |
|---|---|---|---|
| 2,597,894 | 5/1952 | Nordquist | 209/173 X |
| 2,913,113 | 11/1959 | Gillette | 209/215 X |
| 3,749,240 | 7/1973 | Spears et al. | 209/75 |
| 3,822,015 | 7/1974 | Hsieh et al. | 209/173 |

*Primary Examiner*—Robert B. Reeves
*Assistant Examiner*—Joseph J. Rolla
*Attorney, Agent, or Firm*—Thomas M. Marshall

[57] ABSTRACT

There is disclosed a method and apparatus for sorting and classifying cans involving a first step of magnetically separating ferrous and bimetallic cans from aluminum cans. The aluminum cans are then carried to a collecting point. The next step is to separate the ferrous cans from bimetallic cans by immersing both in a liquid bath. The bimetallic cans and some punctured ferrous cans (such as large juice cans) are collected from the top of the bath and carried to a size separating device. The ferrous cans, which are normally fully opened, sink in a bath and are collected by a conveyor from the bottom of the bath. The bimetallic cans and the punctured cans are separated by sizing conveyors and are collected in separate collection devices. The result is to achieve a separation of the three basic classes of cans, reliably and inexpensively.

4 Claims, 4 Drawing Figures

METHOD AND APPARATUS FOR SORTING AND CLASSIFYING METALLIC CANS

SUMMARY OF THE INVENTION

A method and one form of apparatus capable of forming that method are disclosed. Metallic cans are conveyed from a dumping area by a conveyor which has a magnetic means for sorting which results in separating all aluminum cans from the ferrous and bimetallic cans. The aluminum cans thus sorted are conveyed to a collection point. The ferrous and bimetallic cans are fed into a tank of water or similar liquid and are temporarily immersed. The immersion causes nearly all of the ferrous cans to sink to the bottom of the tank where they are picked up by a conveyor and carried out of the tank collecting point. Though immersed, the bimetallic cans, particularly of the "flip top" variety, will float along the top of the water or only partially under the surface of the water. There will also be some ferrous metal cans which will float, i.e., those that are punctured rather than fully opened, for example, large juice cans.

Those cans which float or are only partially immersed are dropped onto a transverse conveyor where they are classified by size with the smaller bimetallic cans falling into a collecting means, while the larger punctured ferrous cans are carried into a separate collecting means or may be, if desired, consolidated with the ferrous cans which have been separated by the bath.

Thus the method provides for an inexpensive, highly reliable way of separating used metallic containers into their three basic types: ferrous, aluminum, and bimetallic. By virtue of this separation process the quality of the recoverable metal, i.e., ferrous metals and aluminum is vastly improved and hence, when reclaimed, is worth considerably more than it would have been worth had the separation process not been performed.

DESCRIPTION

Figures 1, 2:
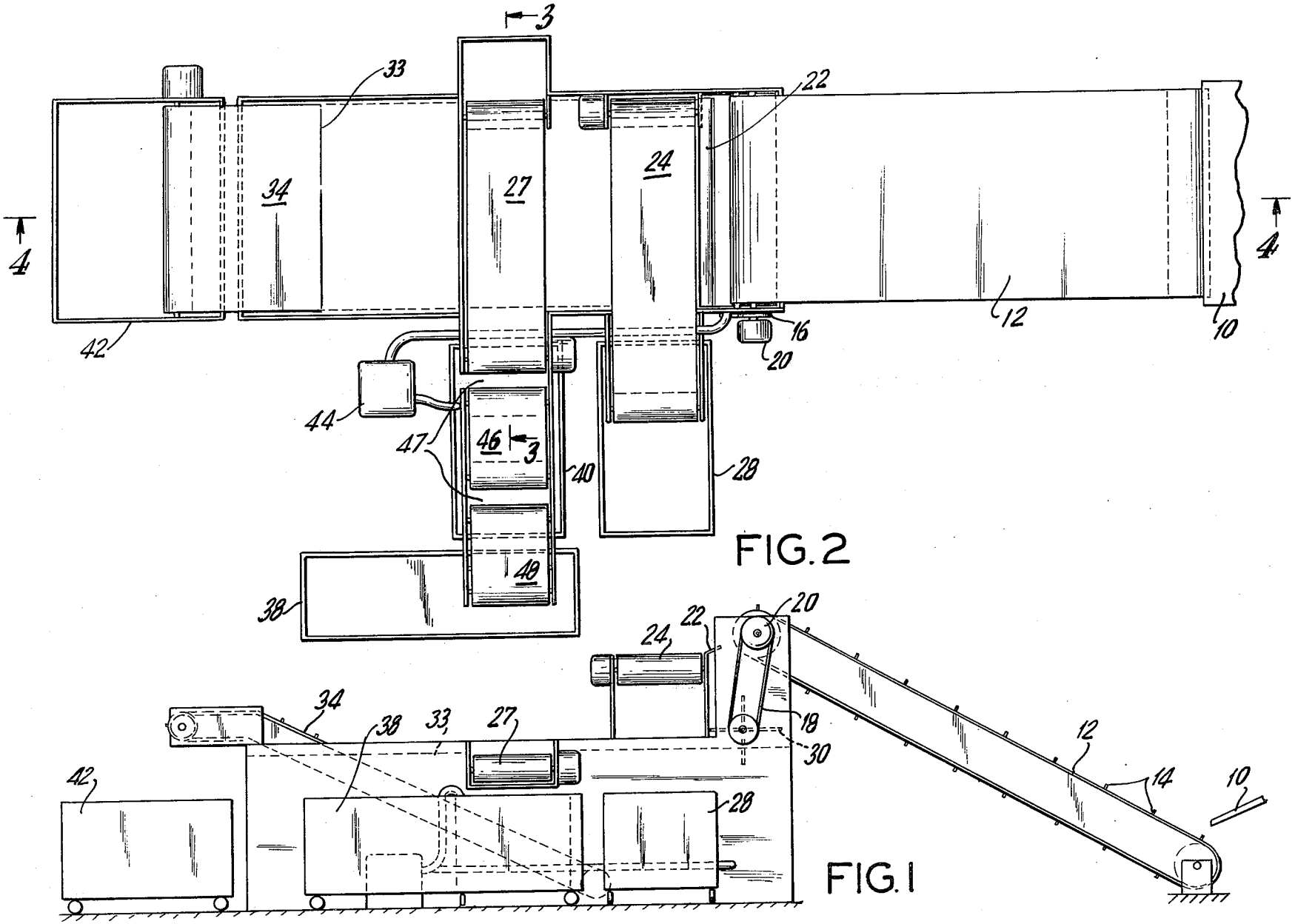
FIG. 1 is a side elavation of a preferred form of apparatus capable of performing the method of this invention.
FIG. 2 is a plan view of the apparatus shown in FIG. 1.

Referring to the device illustrated in the Figures, it will be seen that a chute 10 is provided at the right hand side onto which will be dumped, from trucks or otherwise, a supply of unsorted metallic containers.

It is assumed that by a prior process that the supply of unsorted cans has been obtained by separation from other waste, either at the point of collection of garbage or in some other manner. In at least one case a municipality is requiring that metallic cans be separated from the remainder of the trash and garbage, to permit them to be picked up separately. Thus, it is possible in that municipality to get large truck loads of metallic cans which are to be sorted.

The purpose for sorting the cans is in order to improve the quality, and therefore the value of the scrap, which is obtained by reclaiming the metal in the cans. Basically, the used metallic containers consist of groups of all ferrous, all aluminum, and bimetallic cans. By employing the process of this invention, the all ferrous and all aluminum cans can be separated, thus improving the quality of the scrap recoverable from the separated containers.

Since beverage containers consist roughly 35% of all disposable metal containers and the majority of those are made from either all aluminum or have ferrous sides with aluminum tops, for the reasons given, it is desirable to separate the containers into their three basic groups.

The unsorted containers are dumped by chute 10 into conveyor 12 which has raised projections 14 on it which carry the cans up to a magnetic separation means 16. It should be understood that since the aluminum containers are not affected by the magnet, they would be carried over the top to projection 22 and fall onto conveyor 24 from which they are carried into the receptacle 28. The magnetized roll 16 causes the ferrous and bimetallic containers to remain on the roll 16 until it reaches the underside where, by gravity, they will fall off and fall into the bath 33. It should be understood that the one form illustrated of the magnetic separation by the magnetized conveyor roll 16 could similarly be accomplished by suspended separation magnet or some other suitable means of segregating aluminum cans from the all ferrous or partially ferrous containers. A motor 20 drives the conveyor 12 and a belt 18 drives a paddle wheel 30 suspended over the top of the bath 33.

A number of means may be employed to accomplish the immersion of the ferrous and bimetallic cans in bath 33. The paddle wheel 30 being shown is merely illustrative of one form which will accomplish the purpose. Any means which will cause the cans to be temporarily submerged or immersed is sufficient. What occurs is that many of the ferrous cans such as vegetable cans and many other cans are fully opened by having their top completely removed at the time of use. These cans will quickly fill with water or whatever liquid is used in the bath 33 and will sink to the bottom where they will strike the inclined screen 32 and by gravity be carried down to the conveyor 34 where they are carried up and out of the bath and deposited in receptacle 42.

Other means such as water jets or platens or any appropriate method of immersing the cans for a brief period of time is suitable.

Aerosol cans, beverage containers with flip top covers, and containers with punched tops, the most common example are the large size juice containers (as opposed to food containers with fully opened tops) will then rise and float once they are released by the means employed to force them under the water temporarily. A conveyor 27 situated beneath the water level line positioned transversely to the bath 33 will receive the floating bimetallic and ferrous cans and carry them away from the bath 33.

Figure 3:
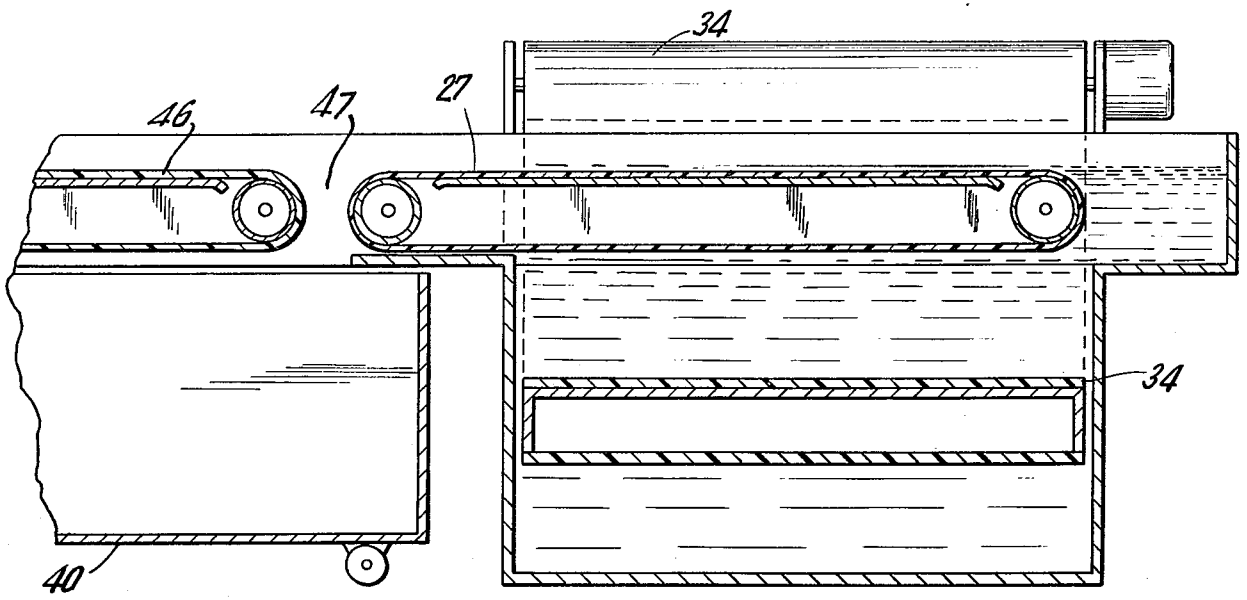
FIG. 3 is a partial cross-sectional view taken along the line 3—3 of FIG. 2.

As illustrated in FIGS. 2 and 3, it can be seen that there are gaps or spaces 47 between successive lengths of conveyor belt 46 and 48. The spacing is such that the smaller size beverage cans, which are largely bimetallic, will fall in one of the two gaps 47 into a receptacle 40. The larger size punched juice containers, for example, do not fit through the spaces or gaps 47 and are thus carried by the second of the two conveyor lengths 48 into a receptacle 38.

It should be understood that the conveyor 48 may extend to an area where receptacle 42 is or that the principally ferrous containers may be collected in two separate receptacles 38 and 42 as illustrated.

Tests have shown that a partially filled container will float with only 18% of its original volume remaining and further tests have shown that a "flip top" beverage can takes from 11 to 13 seconds to fill with water when fully submerged while a fully opened can takes less than 2 seconds. Agitating the cans by means of the paddle wheel 30 or other means while submerged significantly slows the filling process for "flip top" containers but has no effect on fully opened cans. Even though partially or nearly completely crushed, bimetallic cans still float.

Figure 4:
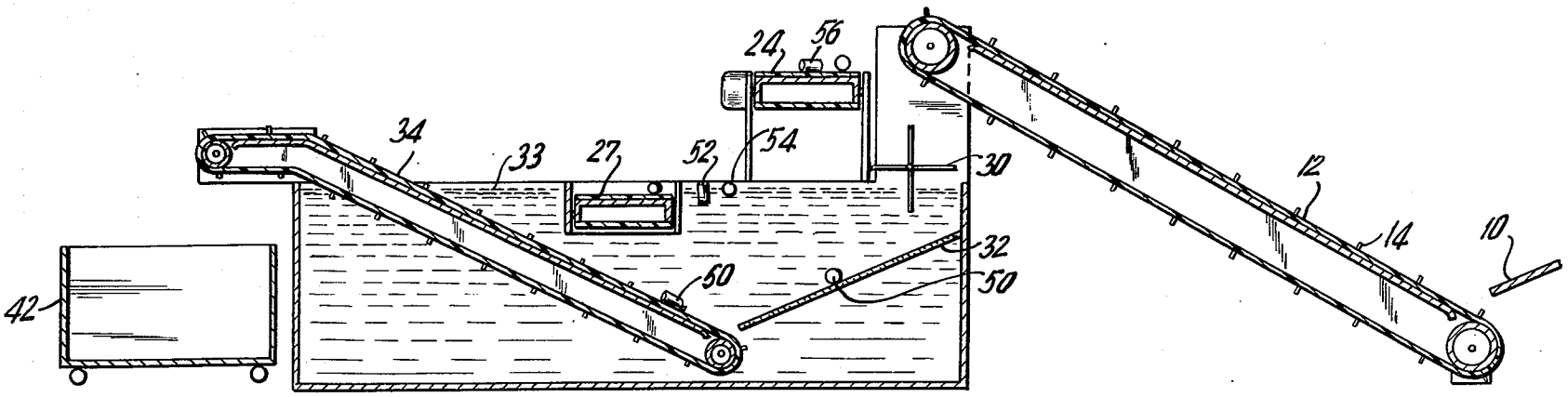
FIG. 4 is a cross-sectional side view taken along the line 4—4 of FIG. 2.

Illustrated generally at 44 in FIG. 2 is a device for keeping the water circulating in the bath 33. Water carried out of the bath by the conveyor 27 is returned to the bath 33 by the recirculating device 44. The conveyor 34 is sufficient in length so that the water drains off and out of many of the ferrous containers, for example, 50 shown in FIG. 4 prior to their being deposited in the receptacle 42. A recirculation filter (not shown) is utilized to clean and filter the liquid being recirculated to the bath.

While reference has been made to the use of water for the bath, it should be understood that any liquid could be used. The specific gravity of the liquid employed may be adjusted so that even aluminum can tops or pull tabs will float and be collected along with the bimetallic cans.

For illustrative purposes, the ferrous can 50 is shown as going down the inclined screen 32 to be deposited on a conveyor 34 where a similar can 50 is caught on one of the projections and is being carried out of the bath. Similarly, the floating cans are illustrated as 52 which could, for example, be a large size juice container and 54 which could be a metallic flip top beverage can.

The aluminum cans are shown on conveyor 24 for illustration as can 56.

It can be seen that the method and apparatus of this invention provides a reliable, inexpensive means of classifying and sorting used metal containers into their three basic types.

It will be understood that there are many other forms that the apparatus as illustrated could take to accomplish the performance of the method of this invention.

What is claimed is:

1. A process for sorting used bimetal, aluminum and ferrous cans comprising:

providing a supply of unsorted used metallic cans;

magnetically separating the ferrous and bimetallic cans from the aluminum cans in said supply;

carrying said separated aluminum cans to a first collecting means;

carrying said ferrous and bimetallic cans to a liquid bath;

immersing said separated ferrous and bimetallic cans in said bath;

collecting said ferrous cans which sink from the bottom of said bath and carrying them into a second collecting means; and collecting said bimetallic cans and ferrous cans which float at or near the top of said bath from said bath and carrying said bimetallic and ferrous cans which floated to the third collecting means.

2. The process of claim 1 including the further step of size separating the bimetallic cans from the ferrous cans which floated and carrying the separated bimetallic cans to said third collecting means and carrying the separated ferrous cans to a fourth collecting means.

3. Apparatus for sorting used bimetal, aluminum and ferrous metal cans comprising:

a first conveyor means for a supply of unsorted used metallic cans;

magnetic sorting means for separating the ferrous and bimetallic cans from the aluminum cans in said supply;

a second conveyor means for carrying said separated aluminum cans to a first collection means;

a liquid bath;

means for immersing said ferrous and bimetallic cans into said bath means;

a third conveyor means for collecting and carrying the ferrous cans which sink in said bath means to a second collecting means; and a fourth conveyor means for collecting and carrying the bimetallic and ferrous cans which float at or near the top of said bath means to a third collecting means.

4. The apparatus of claim 3 in which said fourth conveyor means comprises a first length of conveyor belt positioned to receive said floating cans, a second length of conveyor belt positioned from said first length to define a first space which is slightly larger than the average width of said bimetallic cans and is smaller than the average width of punctured ferrous cans and a third length of conveyor belt positioned from said second length of conveyor belt to define a second space which is approximately the same as the amount that said second length of conveyor belt is spaced from said first length of conveyor belt, said third collecting means underlying said second length of conveyor belt and receiving bimetallic cans through both said spaces; and fourth collection means for receiving said ferrous cans which floated and were separated from said bimetallic cans by said spaces between said first and third lengths of conveyor belt.

* * * * *